US007806736B2

(12) United States Patent
Alderson et al.

(10) Patent No.: US 7,806,736 B2
(45) Date of Patent: Oct. 5, 2010

(54) WIRING DEVICE TERMINAL AND RELATED METHOD OF TERMINATION

(75) Inventors: David Alderson, Morganton, NC (US); Michael D. Williams, Morganton, NC (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 12/165,829

(22) Filed: Jul. 1, 2008

(65) Prior Publication Data

US 2010/0003865 A1 Jan. 7, 2010

(51) Int. Cl.
*H01R 4/30* (2006.01)

(52) U.S. Cl. ..... 439/801; 439/539

(58) Field of Classification Search ..... 439/801–815, 439/709, 539, 719, 723
See application file for complete search history.

(56) References Cited

U.S. PATENT DOCUMENTS

| | | | | |
|---|---|---|---|---|
| 1,994,880 | A | | 3/1935 | Wallbillich |
| 2,015,858 | A | | 10/1935 | Leviton |
| 2,082,994 | A | | 6/1937 | Wallbillich |
| 2,163,722 | A | | 6/1939 | Wallbillich |
| 2,175,098 | A | | 10/1939 | Wertzheiser |
| 2,201,743 | A | | 5/1940 | Petersen |
| 2,201,751 | A | | 5/1940 | Wertzheiser |
| 2,506,212 | A | | 5/1950 | Grohsgal |
| 2,952,831 | A | | 9/1960 | Ehrlich |
| 3,431,546 | A | * | 3/1969 | Averill ..... 439/808 |
| 3,439,315 | A | | 4/1969 | Hamel et al. |
| 3,713,071 | A | | 1/1973 | Poliak et al. |
| 3,740,613 | A | | 6/1973 | Strachan |
| 3,793,607 | A | | 2/1974 | Smith et al. |
| 3,904,266 | A | * | 9/1975 | Fitzpatrick ..... 439/570 |
| 3,944,314 | A | | 3/1976 | Weitzman et al. |
| 3,945,711 | A | | 3/1976 | Hohorst et al. |
| 4,060,305 | A | | 11/1977 | Poliak et al. |
| 4,099,826 | A | * | 7/1978 | Mazzeo et al. ..... 439/389 |
| 4,172,628 | A | | 10/1979 | Lingaraju |

(Continued)

FOREIGN PATENT DOCUMENTS

CA 981354 1/1976

(Continued)

OTHER PUBLICATIONS

PCT Notification of Transmittal of the International Search Report and the Written Opinion of the International Searching Authority for PCT/US2007/007596, dated Sep. 10.

(Continued)

*Primary Examiner*—Ross N Gushi
(74) *Attorney, Agent, or Firm*—Carter, DeLuca, Farrell & Schmidt, LLP

(57) ABSTRACT

A terminal of a wiring device includes a conductive plate, an arm, and a wire guide. The conductive plate has an opening formed therethrough. The conductive plate receives a fastener for securing a substantially straight wire to the conductive plate. The arm extends from the conductive plate and defines a mating element on the wiring device. The arm is an anchor of said conductive plate. The mating element of the arm is adapted to cooperate with a complementary mating element. The wire guide is in spaced relation to the fastener to position the substantially straight wire adjacent to the fastener.

19 Claims, 5 Drawing Sheets

U.S. PATENT DOCUMENTS

| | | | |
|---|---|---|---|
| 4,255,655 | A | 3/1981 | Kikuchi |
| 4,296,987 | A | 10/1981 | Lingaraji |
| 4,372,693 | A | 2/1983 | Lutz |
| 4,537,560 | A | 8/1985 | Emeterio et al. |
| 4,767,340 | A | 8/1988 | Hohorst |
| 4,886,472 | A | 12/1989 | Tsai |
| 4,995,829 | A | 2/1991 | Geib et al. |
| 5,015,201 | A | 5/1991 | Brezee et al. |
| 5,181,310 | A | 1/1993 | Josephson |
| 5,262,749 | A | 11/1993 | Kopelman |
| 5,637,011 | A | 6/1997 | Meyerhoefer et al. |
| 5,825,602 | A | 10/1998 | Tosaka et al. |
| 5,866,844 | A | 2/1999 | Osterbrock et al. |
| 5,975,940 | A | 11/1999 | Hartmann et al. |
| 5,995,350 | A | 11/1999 | Kopelman |
| 6,049,143 | A | 4/2000 | Simpson et al. |
| 6,388,216 | B1 | 5/2002 | Puhalla et al. |
| 6,406,323 | B2 | 6/2002 | Chung Long Shan |
| 6,477,021 | B1 | 11/2002 | Haun et al. |
| 6,689,955 | B2 | 2/2004 | Doutaz |
| 6,707,652 | B2 | 3/2004 | Engel |
| 6,712,641 | B2 | 3/2004 | Beege et al. |
| 6,743,029 | B1 | 6/2004 | Greene et al. |
| 6,750,402 | B2 | 6/2004 | Geske |
| 6,786,779 | B2 | 9/2004 | Feldmeier et al. |
| 6,802,747 | B1 | 10/2004 | Orange |
| 6,827,602 | B2 | 12/2004 | Greene et al. |
| 6,861,189 | B1 | 3/2005 | Greene et al. |
| 6,926,543 | B2 | 8/2005 | Poh et al. |
| 6,943,310 | B2 | 9/2005 | Eisenhower |
| 6,948,846 | B2 | 9/2005 | Engel |
| 7,097,518 | B2 | 8/2006 | Kraemer et al. |
| 7,103,968 | B2 | 9/2006 | Karrasch |
| 7,114,986 | B1 | 10/2006 | Toly |
| 7,115,001 | B1 | 10/2006 | Brockman et al. |
| 7,118,404 | B2 | 10/2006 | Ploesser |
| 7,140,887 | B2 | 11/2006 | Poh et al. |
| 7,150,646 | B2 | 12/2006 | Trumper |
| 7,164,082 | B2 | 1/2007 | Kurek et al. |
| 7,175,485 | B1 | 2/2007 | Alderson et al. |
| 7,241,188 | B2 | 7/2007 | Lin et al. |
| 7,249,963 | B2 | 7/2007 | Ramm |
| 7,270,581 | B2 | 9/2007 | Tiberio |
| 7,547,226 | B2 | 6/2009 | Koessler |
| 7,651,363 | B2 | 1/2010 | Koellmann |
| 2004/0077210 | A1 | 4/2004 | Kollmann |
| 2005/0090159 | A1 | 4/2005 | Luther et al. |
| 2005/0212646 | A1 | 9/2005 | Watchorn |
| 2006/0028316 | A1 | 2/2006 | Fabian et al. |
| 2007/0026701 | A1 | 2/2007 | Kurek et al. |
| 2007/0238348 | A1 | 10/2007 | Kopelman |
| 2008/0013239 | A1 | 1/2008 | Kopelman |

FOREIGN PATENT DOCUMENTS

| | | | |
|---|---|---|---|
| CA | 1202095 | | 3/1986 |
| CA | 1203591 | | 4/1986 |
| CA | 60972 | | 5/1988 |
| DE | 550 863 | C | 5/1932 |
| EP | 01553660 | A1 | 7/2005 |
| EP | 01490928 | B1 | 10/2005 |
| FR | 2 312 767 | | 12/1976 |
| GB | 2 292 850 | A | 3/1996 |
| GB | 2 393 043 | A | 3/2004 |
| JP | 61 014529 | A | 1/1986 |
| WO | WO 97/03480 | | 1/1997 |

OTHER PUBLICATIONS

PCT International Search Report for PCT/US/2007/009433 dated Dec. 20, 2007.

Wago Innovative Connections, Wago Main Selection Page, www.connex-electronics.com/html/products/wago__main__select.html.

Wago Innovative Connections, The Wago Cage Clamp Technology, Electrical Interconnections.

Wago Innovative Connections, 773 Pushwire Connectors, For 10 AWG, Electrical Interconnections.

Wago Innovative Connections, LEVER-NUTS, 222 Series: 3 or 5 COnductor Compact Connectors, Electrical Interconnections.

* cited by examiner

WIRING DEVICE TERMINAL AND RELATED METHOD OF TERMINATION

BACKGROUND

1. Technical Field

The present disclosure relates to a wiring device terminal, and in particular, to a wiring device terminal configured for straight-wire installation and related method of termination.

2. Description of Related Art

Most countries utilize an alternating current based power source to power their electric grid infrastructure (referred to herein as an "AC source"). These systems can be either balanced or unbalanced and may include one or more phases, e.g., a three-phase AC source may include a first wire that provides a zero phase AC source, a second wire that provides a 120-degree phase AC source, a third wire that provides a 240-degree phase AC source and a return path (usually referred to as a "neutral" wire). The "neutral" wire can be used as a return path for the AC source supplied by the first, second and third wires. A wire includes (or is considered to be) a conductive path that can also be referred to as a "line". The terms "line", "conductive line" and "wire" are considered herein to be synonymous, and all include (or is equivalent to) a conductive path.

However, many AC wiring systems (e.g., those found in typical dwellings) also utilize an alternative return path called an earth ground. The earth ground, sometimes referred to as "the ground wire", is generally used as a safety feature by providing an alternative return path to the return path provided by the neutral wire. The earth ground may include several conductive rods that are sufficiently driven into the earth. A number of rods of sufficient length are used to provide a high current capacity conductive connection to the earth with sufficiently low impedance.

Many dwellings and office buildings use either a single-phase, two-phase, or three-phase AC source and/or some combination thereof. The AC source may be accessed by standardized connections (referred to as "plugs") that prevent a user from improperly connecting to an AC source, e.g., a three-phase AC plug cannot connect to a two-phase AC outlet. Additionally, many AC sources may selectively apply electricity to a load based upon whether a switch is turned on or off, e.g., a light switch.

To route, install and otherwise use AC electrical power, manufactures produce many different kinds of devices. These devices are referred to herein as wiring devices. Examples of wiring devices include electrical receptacles, switches, wiring boxes, ground fault circuit interrupters and the like. Typically, these wiring devices have a conductive strap or frame that can be grounded. By grounding the conductive strap, any AC source that unintentionally touches the conductive strap will return the AC current to the earth facilitating the detection of the unsafe condition while mitigating the risk of electric shock.

One method of grounding a wiring device is to ground the conductive frame or strap via a ground terminal. The ground terminal may be a piece of metal, such as a plate that includes a threaded opening for receiving a screw. The ground wire is stripped to expose the conductive layer (i.e., the outer insulating material is removed to expose the inner conductor). The stripped portion of the wire must then be bent or wrapped around the screw in some termination techniques. This is sometimes done using pliers and/or other tools. After the stripped portion of the wire is bent or wrapped around the screw's body, the screw can be tightened. The head of the screw secures the wire to the piece of metal grounding the ground terminal. Some prior art ground terminals have a limited torque capacity because the ground terminal is sometimes an extended thin piece of metal without additional structural support and are difficult to install because rigid wires can be difficult to bend or wrap around the screw.

Other wiring device terminals are also available for terminating wires. In addition to the ground terminals mentioned above, the other terminal types include load or line terminals, and/or neutral terminals. Together these terminals, depending on the mechanical configuration, may be wired using several different standard termination techniques. One such terminal is referred to as "side-wire" (sometimes referred to as "wrap-wire") terminals that are conducive to a termination technique with the same name. To terminate a wire using a side-wire terminal, the wire is initially stripped and the exposed portion of the wire is wrapped around a screw. The screw is then tightened causing the head of the screw to bind the exposed wire between the head of the screw and a metallic plate (e.g., a brass terminal).

Another type of wiring technique is referred to as "back-wire" (also referred to as "clamp-wire"). In back-wire terminals, a screw engages a metallic place with a second metallic plate (referred to as a clamp) to compress a wire therebetween. The metallic plate (or brass terminal) has a threaded opening and the clamp is a second metallic place that slides along the shaft of the screw between the brass terminal and the head of the screw. A stripped wire is placed between the two metallic plates and the screw is tightened to compress the wire.

Yet another type of wiring terminal technique is referred to as a "push-in" technique. Push-in terminals are terminals in which a small hole is available for insertion of a stripped wire. A #14 AWG solid-metal wire is initially stripped about five-eights of an inch from the cut end and the stripped portion is inserted into the hole. A locking mechanism presses down on the wire and maintains electrical contact with the wire for use by the wiring device. The locking mechanism prevents the wire from being pulled out of the hole. To release the wire, a screwdriver is used to press into a release slot releasing the wire.

SUMMARY

The present disclosure relates to a wiring device terminal, and in particular, to a wiring device terminal configured for straight-wire installation and related method of termination.

In one aspect of the present disclosure, a terminal of a wiring device includes a conductive plate and a wire guide. The conductive plate has an opening formed therethrough and receives a fastener for securing a substantially straight wire to the conductive plate. The wire guide is in spaced relation to the fastener and positions the substantially straight wire adjacent to the fastener. The opening may be threaded and the conductive plate may be substantially planar.

In another aspect of the present disclosure, the fastener is a screw having an enlarged head. The enlarged head of the screw includes a concave shaped region on the underside of the enlarged head. The concave shaped region draws the substantially straight wire inward when the screw is tightened. Additionally or alternatively, the terminal may further include a washer forming a hole. The fastener is engaged through the hold of the washer when engaging the opening of the conductive plate. The fastener has an axis of rotation. The washer includes a concave shaped region on a first side and the concave shaped region is configured to draw the substantially straight wire inward when the fastener fastens.

In another aspect of the present disclosure, an arm extending from the conductive plate defines a mating element. The mating element of the arm is adapted to cooperate with a complementary mating element on the wiring device. The arm is an anchor of the conductive plate.

The arm includes a ramp terminating on a ledge defining the mating element. The ledge is at a distal end of the arm and the ramp slopes inwardly from the distal end towards the arm. The complementary mating element is disposed on a wiring device and is a projection and/or a surface within an opening of a wiring module defines the complementary mating element. The complementary mating element includes a ramp terminating on a ledge. The ramp of the complementary mating element slopes outwardly towards the mating element.

The wire guide may be defined by a recessed region of a wiring module. The recessed region receives an end of the substantially straight wire. The wiring module may include one or more of: a resettable circuit interrupting device, a ground fault circuit interrupter, an arc fault circuit interrupter, an immersion detection circuit interrupter, an appliance leakage circuit interrupter, equipment leakage circuit interrupter, a circuit breaker, a contactor, a latching interrupting device, a fuse, a receptacle, a switch, a lighting control, an occupancy sensor and/or a button. Additionally or alternatively, the wire guide is formed by a cover of a strap. The wire guide may include two approximately wedge shaped surfaces with a connecting surface (or surfaces) that guides a wire towards the "apex" of the wedges. Additionally or alternatively, the wedges may also guide a wire towards the apex of the wiring channel.

The terminal may includes a wire trap defined by the conductive plate. The wire trap may be a concave tapering flange shaped to guide the substantially straight wire towards the fastener. Additionally, a ridge may be at least partially disposed around the fastener. The ridge is shaped to guide the substantially straight wire towards the fastener.

In yet another aspect of the present disclosure, a method of termination includes the step of electrically connecting the substantially straight wire to the terminal of a wiring device. The method includes the steps of cutting the substantially straight wire and removing an insulating layer of the substantially straight wire forming an exposed length. The method also includes the steps of and positioning the end of the substantially straight into the wire guide and securing the substantially straight wire to the conductive plate with the fastener.

BRIEF DESCRIPTION OF THE DRAWINGS

These and other advantages and aspects will become more apparent from the following detailed description of the various embodiments of the present disclosure with reference to the drawings wherein.

DETAILED DESCRIPTION

Figure 1A:
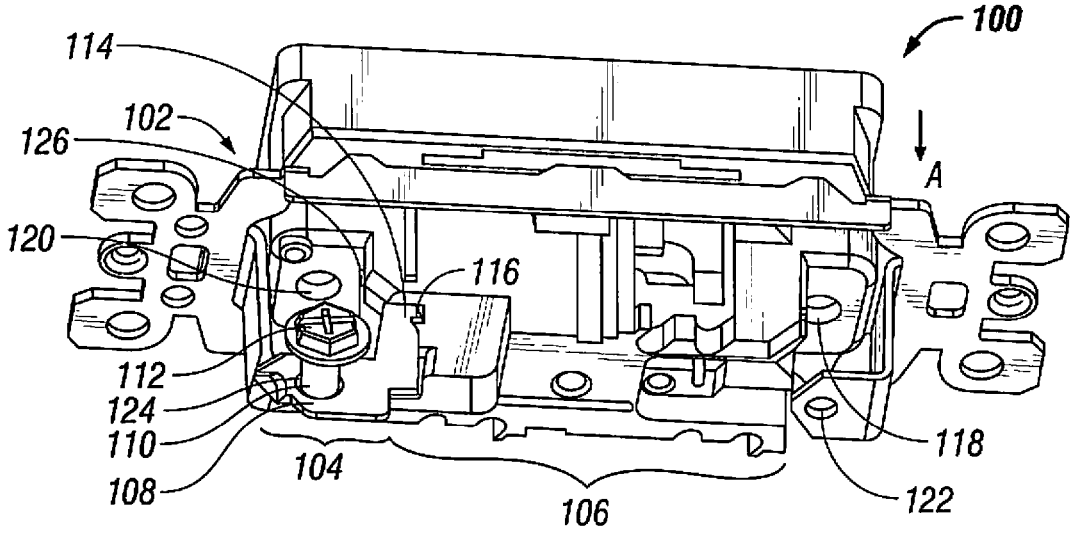
FIG. 1A is a perspective view of a wiring device having a ground terminal and a wiring module which can be connected to the strap of the wiring device in accordance with the present disclosure.
Figure 1B:
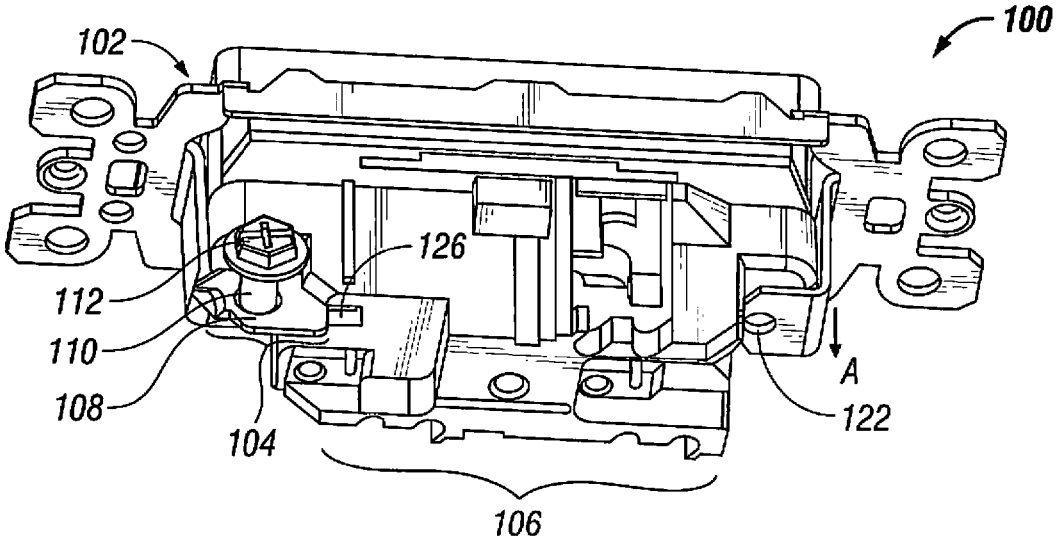
FIG. 1B is a perspective view of the wiring device of FIG. 1A with the wiring module connected to the strap of the wiring device in accordance with the present disclosure.

Referring to the drawings, FIGS. 1A and 1B show a wiring device 100 in accordance with the present disclosure. Wiring device 100 includes conductive strap 102 that provides structural integrity and overall device grounding, e.g., such as by grounding the conductive strap 102 to earth ground. The conductive strap may also known as a frame or a yoke in the electrical industry. Grounding of conductive strap 102 is accomplished by connecting a ground wire to ground terminal 104. Ground terminal 104 is conductively connected to conductive strap 102. Ground terminal 104 and/or conductive strap 102 may be made from any suitable metals, alloys, or other materials such as aluminum, carbon, copper, gold, iron, manganese, nickel, palladium, platinum, steel, tin, tungsten, zinc and/or the like.

Ground terminal 104 includes a conductive plate such as metallic plate 108, which has a substantially planar shape. The conductive plate has an opening formed therethrough that can receive a fastener. For example, metallic plate 108 includes a threaded opening that can receive a screw 110 with an enlarged head 112. The ground terminal includes an arm 114 extending from the conductive plate. The arm 114 defines a mating element configured to cooperate with a complementary mating element to form a torque-resistant assembly configured for resisting torque from the plate. For example, ground terminal 104 further includes a lever arm 114 that includes ramp 116. Ramp 116 slopes inwardly towards arm 114 and terminates on a ledge. The torque-resistant assembly is more easily seen in FIG. 2.

Referring to FIGS. 1A and 1B, note that wiring module 106 is in two differing positions. In FIG. 1A, wiring module 106 is slightly out of position for securing to conductive strap 102 in the opposite direction of the direction indicated by arrow A. Wiring module 106 has threaded holes 118 and 120 that can receive a screw, bolt or other sufficient fastener. Threaded holes 118 and 120 cooperate with holes 122 and 124, respectively, of conductive strap 102 to secure wiring module 106 thereto (hole 124's view is obstructed in FIGS. 1A and 1B). For example, as more easily viewable in FIG. 1B, threaded hole 118 of wiring module 106 is aligned with and is in close proximity to hole 122 of conductive strap 102 (threaded hole 118 is not visible in FIG. 1B. In FIG. 1B, however wiring module 106 has moved along arrow A shown in FIG. 1A. Additionally or alternatively, wiring module 106 may include one or more "snap" type devices making it a snap-on or snap-fit wiring device (also a wiring module may be incorporated into a strap and/or a frame of a wiring device).

When a securing member is introduced into holes 122 and 124, wiring module 106 can be secured to conductive strap 102. Wiring module 106 may include a resettable circuit interrupting device, a ground fault circuit interrupter, an arc fault circuit interrupter, an immersion detection circuit interrupter, an appliance leakage circuit interrupter, an equipment leakage circuit interrupter, a circuit breaker, a contactor, a latching interrupting device, a fuse, a receptacle, a switch, a lighting control, an occupancy sensor, a button and/or the like. Wiring module 106 may be selected based upon customer preferences, market conditions, or other preferences or conditions. For example, it may be more efficient to manufacture a common conductive strap, e.g., conductive strap 102, and insert therein a module based upon orders from customers, such as orders for GFCI devices, AC receptacles and the like.

Additionally or alternatively, wiring module 106 may include one or more wire receptacles (not shown), such a hole that can secure a wire with a screw or other sufficient fastener. The wire receptacles may be for a neutral wire, a hot wire, and/or a ground wire. For example, the back of wiring module 106 may have one or more places to connect a wire to the internal components of wiring module 106. Additionally or alternatively, the wire receptacle may be for receiving an AC plug.

Referring again to FIGS. 1A and 1B, ground terminal 104 includes metallic plate 108 with hole 124 that can receive screw 110 with an enlarged head 112. Additionally, ground terminal 104 includes lever arm 114 that has ramp 116. Note that wiring module 106 has a surface defining an opening 126. The surface defines a complementary mating element within opening 126. Lever arm 114 with ramp 116 are received by opening 126 to cooperate with the complementary mating element (e.g., an internal flange), such that ramp 116 of lever arm 114 and the complementary mating element form a torque-resistant assembly.

Figure 1C:
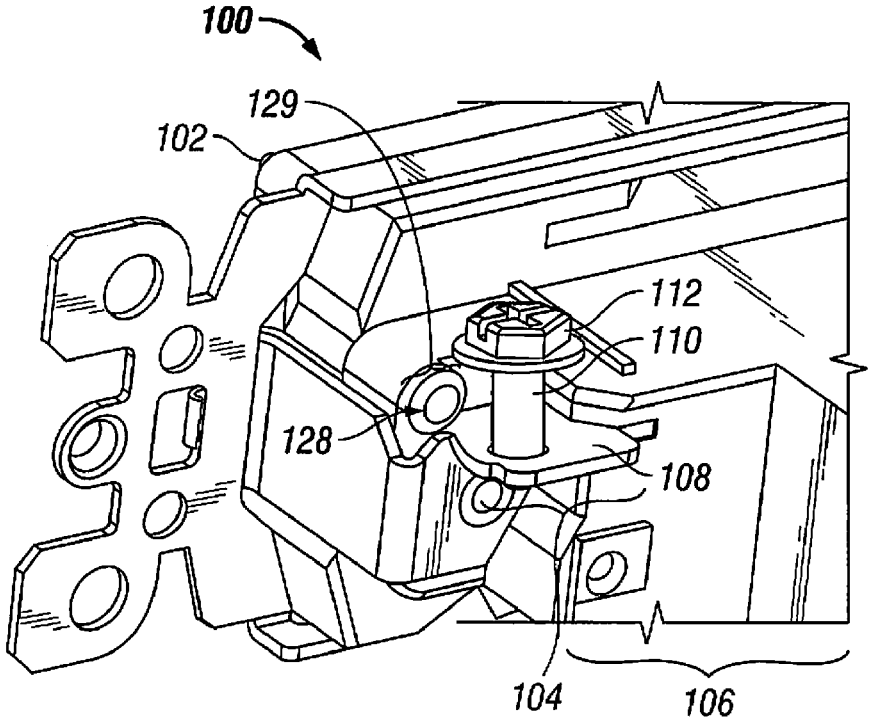
FIG. 1C is a perspective, close-up view of a wiring device showing a recessed region of the wiring module as attached to the wiring device in accordance with the present disclosure.
Figure 1D:
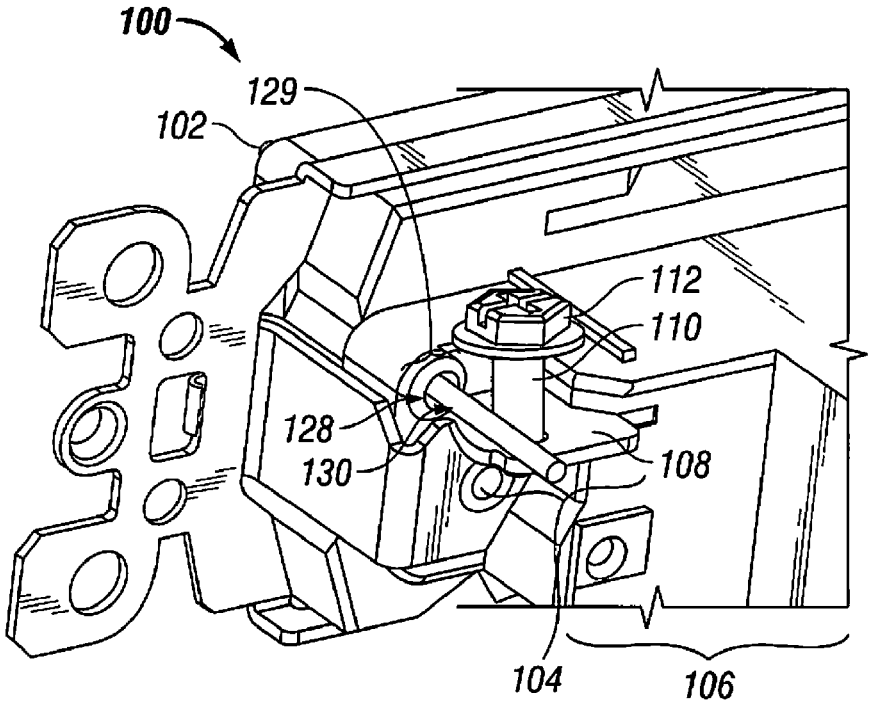
FIG. 1D is a perspective, close-up view of the wiring device of FIG. 1C showing the recessed region of the wiring module as attached to the wiring device with an end of a ground wired received by the recessed region in accordance with the present disclosure.
Figure 4:
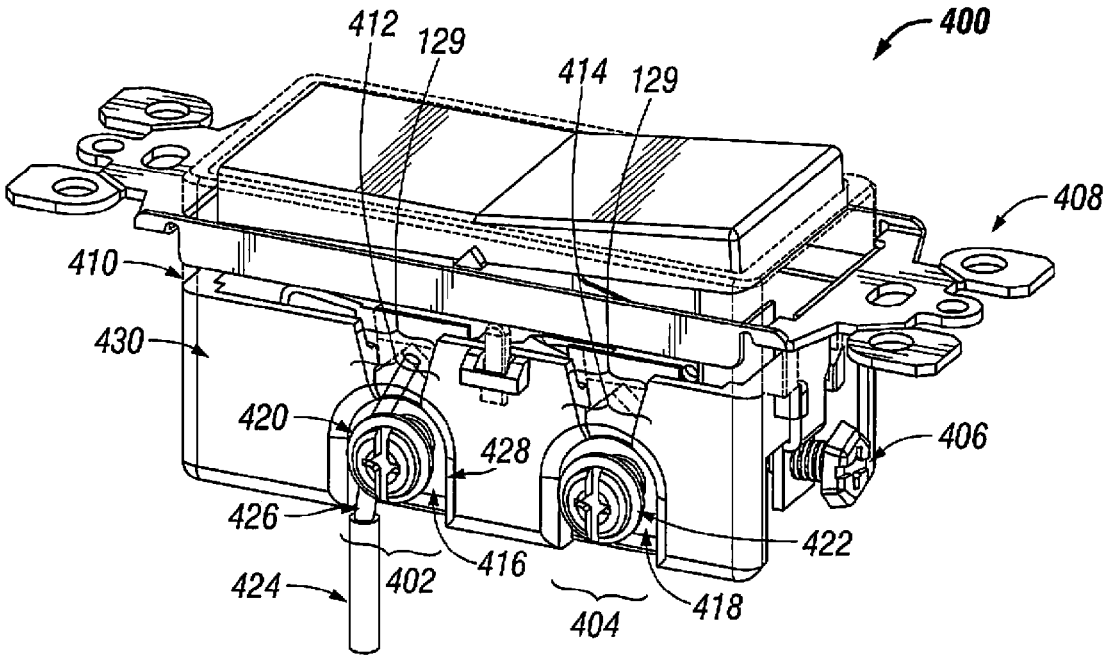
FIG. 4 is a side-view of another embodiment of a wiring device having two side terminals with a wiring channel in accordance with the present disclosure.

Referring to the drawings, FIGS. 1C and 1D show two perspective, close-up views of wiring device 100 having a ground terminal 104 and a recessed region 128. In the embodiment depicted in FIGS. 1C and 1D, a wire guide 129 is shown as recessed region 128. Wire guide 129 is in spaced relation to screw 110. Wire guide 129 positions the substantially straight wire 130 adjacent to screw 110. Wire guide 129 may be defined by a recessed region 128 as shown in FIGS. 1C and 1D. The recessed region 128 receives an end of the substantially straight wire 130. However, in another embodiment as shown in FIG. 4, two wire guides 129 are shown as wiring channels 412 and 414. Wiring channels 412 and 414 are internal to strap cover 410. The wiring channels 412 and/or 414 may include two approximately wedge shaped surfaces that guides a wire 424 towards the "apex" of the wedges thereby positioning the substantially straight wire 424 adjacent to the screw 110.

Referring again to FIGS. 1C and 1D, wiring module 106 is capable of securing to conductive strap 102 and includes recessed region 128. Recessed region 128 receives an end of a ground wire, e.g., as shown in FIG. 1D, recessed region 128 receives ground wire 130. Recessed region 128 positions ground wire 130 substantially straight for securing to metallic plate 108 while remaining straight. Securing a wire to a terminal while the wire remains substantially straight is referred to herein as a "straight-wire" installation. Ground terminal 104 is capable of straight-wire installation as facilitated by recessed region 128. Note that in FIGS. 1C and 1D, recessed region 128 is in spaced relation to screw 110 such that while inserting ground wire 130 into recessed region 128, ground wire 130 is in a position to facilitate securing to metallic plate 108 by enlarged head 112 when tightening screw 110.

Note that in FIGS. 1C and 1D, recessed region 128 allows ground wire 130 to have an exposed end inserted into recessed region 128 without any wire bending or wrapping. Thereafter, screw 110 may be tightened to secure ground wire 130 to metallic plate 108 while remaining substantially straight.

Figure 2:
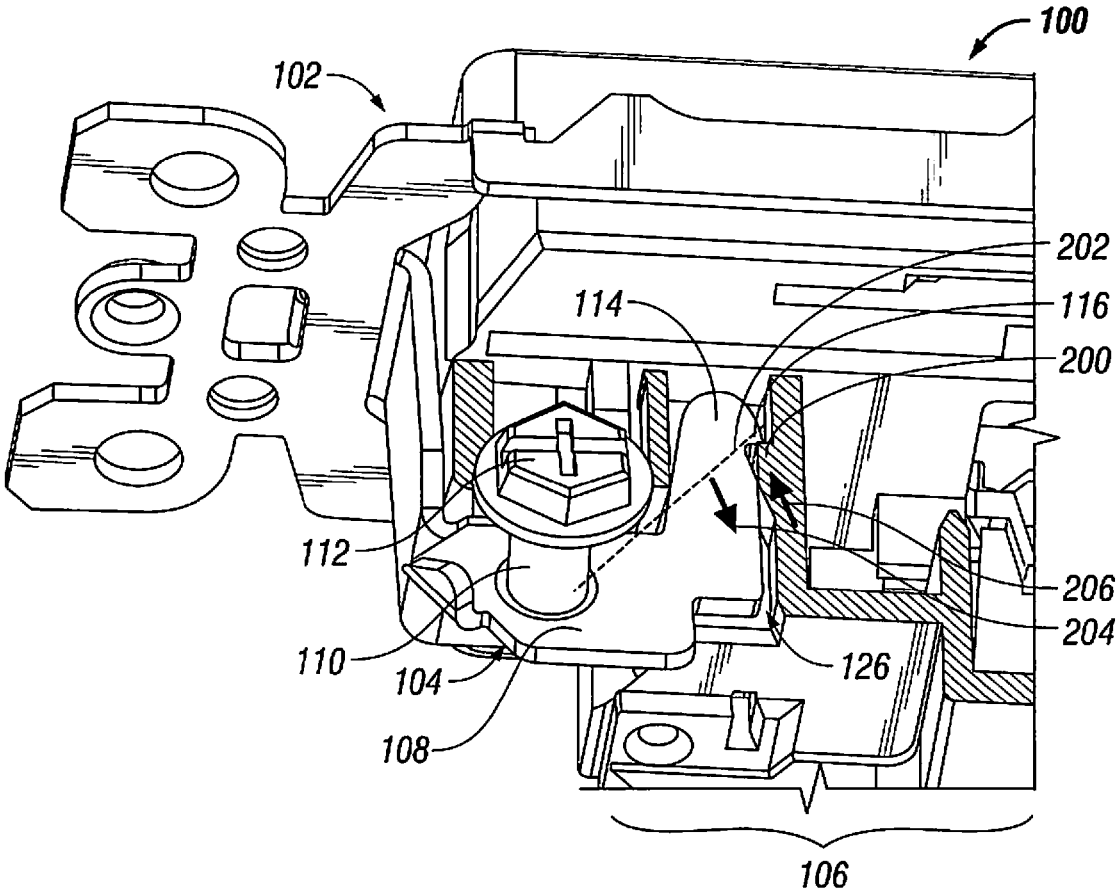
FIG. 2 is a close-up view of the ground terminal of the wiring device of FIGS. 1A and 1B with a cut-away view of the wiring module in accordance with the present disclosure.

Referring now to FIG. 2, wiring module 106 is shown as being partially cut-away so that a complementary mating element is shown, i.e., ramp 200. Ramp 200 slopes outwardly towards lever arm 114. Lever arm 114 includes ramp 116 that cooperates with ramp 200 to form a torque-resistant assembly. To ground conductive strap 102, a substantially straight and partially exposed ground wire is placed between metallic plate 108 and enlarged head 112 preferably touching the shaft of screw 110. An end of the exposed wire (not shown) may be inserted into a recessed region (the cut away causes the recessed region to not be visible) eliminating the need to bend or wrap the ground wire around screw 110. Thereafter, a screwdriver, such as a screwdriver having a Phillips head, is used to apply torque to screw 110 such that enlarged head 112 advances towards metallic plate 108.

As screw 110 is tightened, the ground wire (not shown) is pressed between enlarged head 112 and metallic plate 108. Eventually, the torquing of screw 110 will translate torque to metallic plate 108 when the wire is frictionally locked between enlarged head 112 and metallic plate 108. When the torque is translated to metallic plate 108, such as when the torque is applied in a clockwise motion from a top view of screw 110, metallic plate 108 experiences the torque as well. The torque on metallic plate 108 is shown as force arrow 204 along axis 202. When ramp 116 and ramp 200 are locked, lever arm 114 resists the torque and resists being pulled out of opening 126, this resistance is shown as force arrow 206. Force arrows 204 and 206 are about equal. The additional support resulting from force arrow 206 provides additional structural support such that metallic plate 108 has a greater torque capacity; i.e., because ground terminal 104 has a lever arm 114 with ramp 116 that locks with ramp 200, the amount of torque that can be applied to screw 110 is increased improving the torque tolerances of wiring device 100.

Although ramp 200 is shown as being rigid and non-movable, in another embodiment ramp 200 may be moveable. For example, wiring module 106 may include a "quick release" button that when pressed moves ramp 200 away from lever arm 114 (and thus ramp 116 as well) releasing lever arm 114 from wiring module 106. A quick release button may also be used to assist in the removal of wiring module 106 from conductive strap 102.

Figure 3:
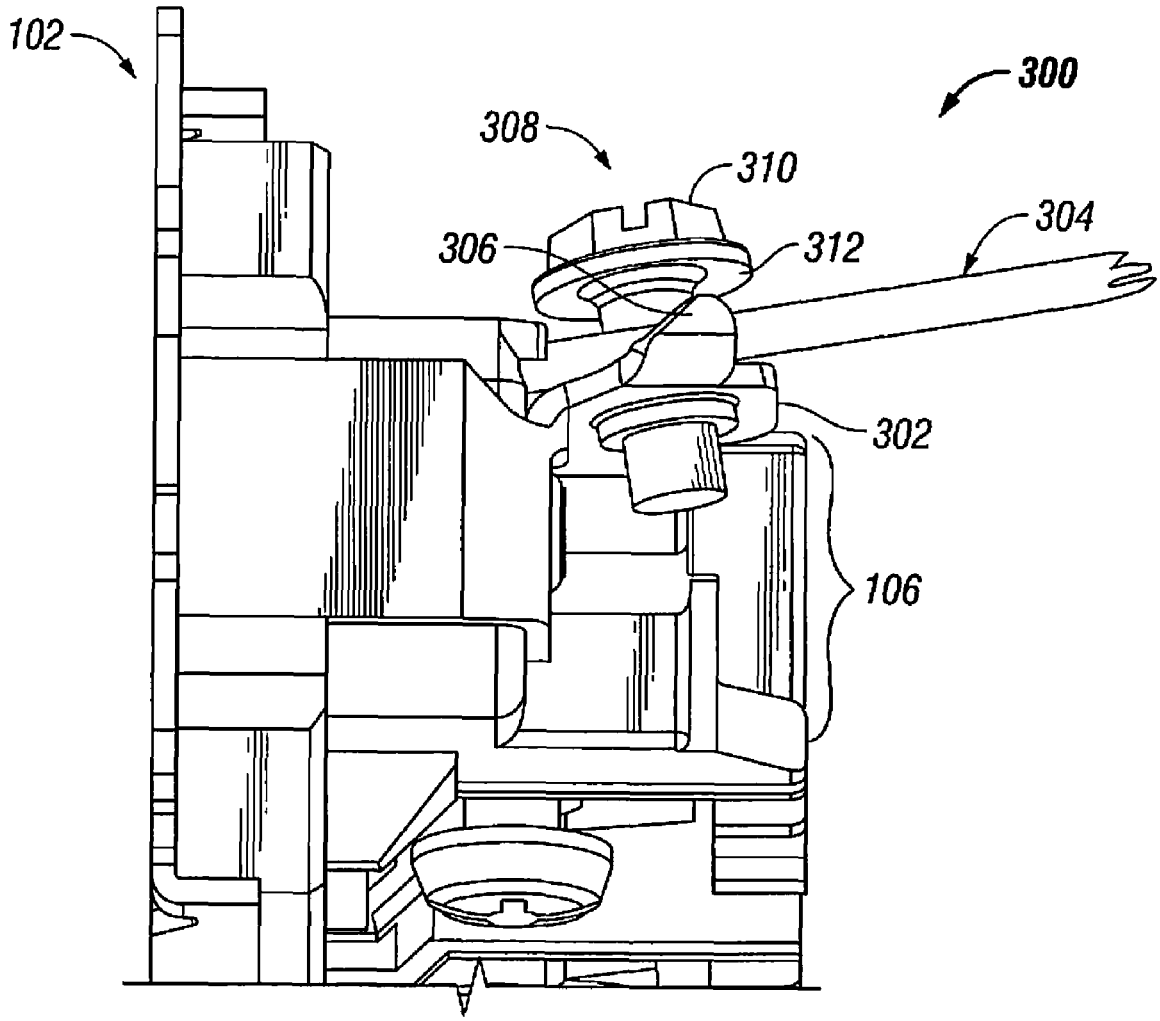
FIG. 3 is a close-up view of another embodiment of a wiring device having a ground terminal that includes a wire trap that is a concave tapering flange shaped to guide the ground wire towards the screw of the ground terminal in accordance with the present disclosure.

Referring to the drawings, FIG. 3 shows a wiring device 300 that is another embodiment of a wiring device in accordance with the present disclosure. Wiring device 300 includes ground terminal 302 that can ground conductive strap 102. Wiring device 300 has a ground wire 304 positioned to connect to ground terminal 302. Ground wire 304 is used to 'ground' ground terminal 302. Additionally, when ground wire 304 is connected to ground terminal 302, conductive strap 102 is also grounded because it is conductively connected to ground terminal 302.

Ground terminal 302 includes wire trap 306 defined by the metallic plate. Wire trap 306 guides ground wire 304 to its proper place while screw 308 is tightened. Wire trap 306 is a concave tapering flange that has sufficient shape and/or dimensions to guide ground wire 304 towards screw 308.

A screwdriver can engage enlarged head 310 of screw 308. The screwdriver can then be used to apply torque in a sufficient direction (in this example, clockwise from above) causing screw 308 to rotate clockwise. As screw 308 rotates clockwise, enlarged head 310 approaches ground wire 304. The clockwise rotation torques ground terminal 302 in a clockwise direction as well. If screw 308 is turned enough, ground wire 304 becomes frictionally locked between enlarged head 310 and the metallic plate of ground terminal 302. When ground wire 304 is frictionally locked between enlarged head 310 and the metallic plate of ground terminal 302, any additional torque applied is wholly transferred to ground terminal 302. As previously mentioned, the torque may be countered by a lever arm such as lever arm 114 with ramp 116 of FIG. 2.

Enlarged head 310 approaches ground wire 304 to meet ground wire 304 as screw 308 is turned. Enlarged head 310 includes underside 312 that includes a concave shaped region that draws the ground wire 304 inward as screw 308 is turned. Note that the concave shaped region of underside 312 forms a "rim" that grips into ground wire 304. The gripping assists in securing ground wire 304 to ground terminal 302 and also helps ensure that conductive strap 102 is properly grounded. Additionally or alternatively, wiring device 300 (and/or wiring device 100 of FIGS. 1A, 1B and 2) may include a washer (not shown) that is threaded through screw 308 (or screw 110) with a concave shaped region that similarly grips into ground wire 304 as screw 308 is turned.

Referring to the drawings, FIG. 4 shows a side-view of another embodiment of a wiring device 400 having side terminals 402 and 404 in accordance with an embodiment of the present disclosure. Terminals 402 and 404 may be either a load terminal or a neutral terminal. Wiring device 400 also includes ground terminal 406, strap 408, strap cover 410, and wire guides 129. The two wire guides 129 are shown as wiring channels 412 and 414. Wiring channels 412 and 414 are internal to strap cover 410. Strap cover 410 extends towards screws 420 and 422 forming wiring channels 412 and 414. Wiring channels 412 and 414 are internal to strap cover 410 and each include two approximately parallel wedge-shaped surfaces (with a surface connecting the edges of the two wedge-shaped surfaces) configured to guide the exposed length 426 of wire 424 towards the apex of the two parallel wedge-shaped surfaces when inserting the exposed length 426 of wire 424 (as shown in FIG. 4) into one of wiring channels 412 and/or 414.

Terminals 402 and 404 include metallic plates 416 and 418, respectively. Terminal 402 has a screw 420 for engaging through a threaded opening (not shown) while and terminal 404 includes a screw 422 for engaging through a threaded opening. For illustration purposes only, consider the straight-wire termination of a wire 424. Wire 424 includes an exposed length 426. Exposed length 426 is illustrated as being inserted between plate 416 and the enlarged head of screw 420. Note that a base 430 forms a ridge 428 around screw 420. In the embodiment shown in FIG. 4, ridge 428, complimented by wire guide 129 which guides substantially straight wire 424, forms an approximate U-shape region around screw 420 approximately around the circumference of screw 420. The ridge 428 is illustrated as being at least partially disposed around screw 420 (a fastener). While inserting wire 424 into terminal 402 for straight wire termination, ridge 428 guides the wire to be against screw 420 and into wiring channel 412. Note that wire 424 is substantially straight. Turning screw 420 secures exposed length 426 to plate 416 while wire 424 remains substantially straight, thereby facilitating the straight-wire termination.

Figure 5:
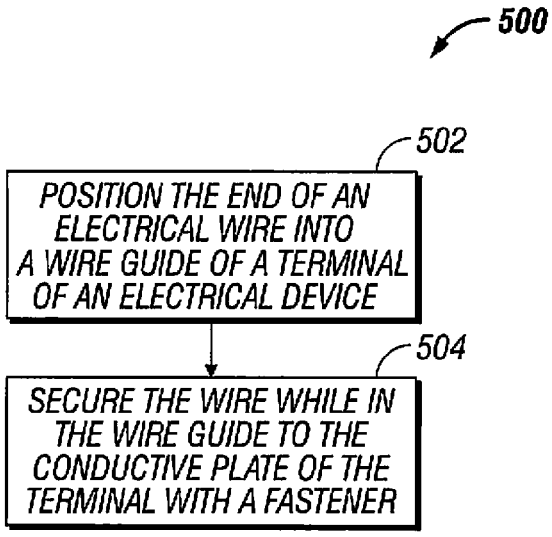
FIG. 5 is a flow chart diagram of a method of termination in accordance with the present disclosure.

Referring to the drawings, FIG. 5 shows a flow chart diagram of a method 500 of termination utilizing a ground terminal in accordance with the present disclosure. Method 500 includes steps 502 and step 504. Step 506 can position the end of an electrical wire into a wire guide of a terminal of an electrical device. The wire guide of step 506 may be recessed region 128 of FIG. 1C and/or wiring channels 412 or 414. The terminals referred to may be terminal 104 of FIGS. 1A-1C, or terminals 402 and 404 of FIG. 4. Step 510 secures the wire while in the wire guide to the conductive plat of the terminal with a fastener, e.g., screwing in screws 110 of FIG. 1 through 2, screw 302 of FIG. 3, and/or screws 420 and 422 of FIG. 4.

While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A wiring device comprising:

a terminal including:

a conductive plate defining a first surface having an opening formed therethrough, wherein the conductive plate is configured to receive a fastener; and an arm having proximal and distal ends, the proximal end connecting to and extending from the conductive plate, the distal end defining a mating element adapted to cooperate with a complementary mating element on the wiring device, wherein the proximal and distal ends of the arm are approximately parallel to the first surface of the conductive plate;

said arm is an anchor of said conductive plate; and a wire guide in operable association with the fastener, the wire guide positioned adjacent the conductive plate of the terminal;

wherein the fastener is a screw having a head, the fastener configured to (i) receive a wire from the wire guide, (ii) temporarily secure and stabilize the wire as a straight wire while a force is applied to the head of the screw, and (iii) after the force is applied, permanently secure the straight wire between an underside portion of the head and the conductive plate of the terminal, wherein the wiring device includes a ramp terminating on a ledge defining the complementary mating element.

2. The wiring device of claim 1, wherein the opening is a threaded opening.

3. The wiring device of claim 1, wherein the conductive plate is substantially planar.

4. The wiring device of claim 1, further comprising a washer with a centered hole, wherein the fastener is engaged through the hole of the washer when engaging the opening of the conductive plate.

5. The wiring device of claim 4, wherein the fastener has an axis of rotation and the washer includes a concave shaped region on a first side and the concave shaped region.

6. The wiring device of claim 1, wherein the arm includes a ramp terminating on a ledge defining the mating element.

7. The wiring device of claim 6, wherein the ledge is at a distal end of the arm and the ramp slopes inwardly from the distal end towards the arm.

8. The wiring device of claim 1, wherein the ramp slopes outwardly towards the mating element.

9. The wiring device of claim 1, wherein the complementary mating element on the wiring device is a projection.

10. The wiring device of claim 1, further comprising:

a surface forming a recessed region and defining the wire guide, wherein the recessed region is configured to receive an end of the straight wire.

11. The wiring device of claim 10, wherein the recessed region is a blind hole.

12. The wiring device of claim 1, further comprising a wire trap, wherein the wire trap is defined by the conductive plate.

13. The wiring device of claim 12, wherein the wire trap is a concave tapering flange shaped to guide the straight wire towards the fastener.

14. The wiring device of claim 12, wherein the fastener is a screw having an axis of rotation defined along a length thereof, and the axis of rotation of the screw is about perpendicular to the conductive plate, wherein the wire trap is a concave tapering flange having a surface curving from about parallel to the conductive plate towards about parallel to the axis of rotation.

15. A method of termination, comprising the steps of:

electrically connecting a wire to a terminal of a wiring device, said wiring device comprising:

a terminal including;

a conductive plate defining a first surface having an opening formed therethrough, wherein the conductive plate is configured to receive a fastener; and an arm having proximal and distal ends, the proximal end connecting to and extending from the conductive plate, the distal end defining a mating element adapted to cooperate with a complementary mating element on the wiring device, wherein the proximal and distal ends of the arm are approximately parallel to the first surface of the conductive plate;

said arm is an anchor of said conductive plate; and a wire guide in operable association with the fastener, the wire guide positioned adjacent the conductive plate of the terminal;

wherein the fastener is a screw having a head, the fastener configured to (i) receive a wire from the wire guide, (ii) temporarily secure and stabilize the wire as a straight wire while a force is applied to the head of the screw, and (iii) after the force is applied, permanently secure the straight wire between an underside portion of the head and the conductive plate of the terminal, wherein the wiring device includes a ramp terminating on a ledge defining the complementary mating element.

16. The method of claim 15, further comprising the step of: cutting the wire.

17. The method of claim 15, further comprising the step of: removing an insulating layer of the wire forming an exposed length.

18. The method of claim 15, further comprising the step of: positioning an end of the wire into the wire guide.

19. A wiring device comprising:

a terminal including;

a conductive plate defining a first surface having an opening formed therethrough, wherein the conductive plate is configured to receive a fastener;

a ridge at least partially disposed around the fastener and forming an approximate U-shape around the fastener, the approximate U-shape of the ridge having an opening and a depression at an opposite end thereof;

a wiring channel formed within a strap cover at the depression of the U-shape portion of the ridge between a top surface of the ridge and the conductive plate, the wiring channel adapted to position the straight wire about adjacent to the fastener, the wiring channel including:

two substantially wedge-shaped surfaces each having at least one edge, wherein the two substantially wedge-shaped surfaces are approximately parallel; and a connecting surface defining an enclosure between each of the at least one edge of the two substantially wedge-shaped surfaces;

a body forming the wiring channel and the ridge; and a wire guide in operable association with the fastener, the wire guide positioned adjacent the conductive plate of the terminal;

wherein the fastener is a screw having a head, the fastener configured to (i) receive a wire from the wire guide, (ii) temporarily secure and stabilize the wire as a straight wire while a force is applied to the head of the screw, and (iii) after the force is applied, permanently secure the straight wire between an underside portion of the head and the conductive plate of the terminal.

* * * * *

UNITED STATES PATENT AND TRADEMARK OFFICE

CERTIFICATE OF CORRECTION

PATENT NO. : 7,806,736 B2
APPLICATION NO. : 12/165829
DATED : October 5, 2010
INVENTOR(S) : David Alderson and Michael D. Williams It is certified that error appears in the above-identified patent and that said Letters Patent is hereby corrected as shown below:

Column 2:

Line 22, “metallic place” should read -- metallic plate --.

Column 7:

Line 65, “Step 506” should read -- Step 502 --.

Line 67, “Step 506” should read -- Step 502 --.

Column 8:

Line 3, “Step 510” should read -- Step 504 --.

Line 4, “conductive plat” should read -- conductive plate --.

Signed and Sealed this
Seventeenth Day of May, 2011

David J. Kappos

David J. Kappos
*Director of the United States Patent and Trademark Office*